United States Patent [19]

Watanabe et al.

[11] Patent Number: 5,019,452

[45] Date of Patent: May 28, 1991

[54] THERMAL TRANSFER MATERIAL

[75] Inventors: Niro Watanabe, Oomiya; Masato Yoshida, Kasukabe; Noriyuki Ito, Saitama, all of Japan

[73] Assignee: Toppan Printing Co., Ltd., Tokyo, Japan

[21] Appl. No.: 534,357

[22] Filed: Jun. 6, 1990

Related U.S. Application Data

[63] Continuation of Ser. No. 168,183, Mar. 15, 1988, abandoned.

[30] Foreign Application Priority Data

Mar. 18, 1987 [JP] Japan ..... 62-63529
Nov. 4, 1987 [JP] Japan ..... 62-278896
Nov. 28, 1987 [JP] Japan ..... 62-301377

[51] Int. Cl.[5] ..... B41M 5/26

[52] U.S. Cl. ..... 428/422; 428/195; 428/474.4; 428/480; 428/484; 428/488.4; 428/500; 428/913; 428/914

[58] Field of Search ..... 428/195, 484, 488.1, 428/488.4, 913, 914, 422, 474.4, 480, 500

[56] References Cited

U.S. PATENT DOCUMENTS 4,755,432 7/1988 Asano et al. ..... 428/488.4
4,756,950 7/1988 Matsushita et al. ..... 428/484

FOREIGN PATENT DOCUMENTS 0124616 11/1984 European Pat. Off. ..... 428/195
0194106 9/1986 European Pat. Off. ..... 428/195
0208385 1/1987 European Pat. Off. ..... 428/195
0210838 2/1987 European Pat. Off. ..... 428/195

OTHER PUBLICATIONS

Chemical Abstracts: vol. 10, No. 10 (M-446) [2067]1/16/86, Nippon Victor K.K.
Chemical Abstracts: vol. 9, No. 264 (M-423) [1987], 10/22/85, Sanyo Denki K.K.

*Primary Examiner*—Pamela R. Schwartz
*Attorney, Agent, or Firm*—Bacon & Thomas

[57] ABSTRACT

Thermal transfer material which is adopted for use in transferring an image of high resistances to wear, water and chemicals on a plastic base such as pre-paid card, coupon card and the like. The thermal transfer material comprises a heat-resistant support and a thermal transfer recording layer stacked on the support. The thermal transfer recording layer comprises a coloring agent, a hot-melt material comprising a thermoplastic resin having a glass transition point of 50 to 110° C., and a lubricant. There is also proposed a recording material adopted for use in combination with the thermal transfer material. The recording material comprises a support and an image-receiving layer formed on the support and comprising a lubricating agent and a thermoplastic resin having a glass transition point of 50° to 110° C. A method of transfer-recording using the thermal transfer material and the recording material is also proposed.

6 Claims, 2 Drawing Sheets

THERMAL TRANSFER MATERIAL

This application is a continuation of application Ser. No. 07/168,183, now abandoned.

BACKGROUND OF THE INVENTION

1. Field of the Invention

The present invention relates to a thermal transfer material which can be thermally transferred by a thermal medium such as a thermal head, a recording material used in combination with the thermal transfer material, and a thermal transfer recording method using the thermal transfer material and the recording material and, more particularly, to a thermal transfer material, a recording material, and a thermal transfer recording method capable of forming an image with good resistance to a plasticizer, chemical resistance, and mechanical strength.

2. Description of the Prior Art

Heat-sensitive recording systems have been widely used in the fields of a facsimile or various printers because they are of dry type and can perform maintenance free recording. Recently, as an application of these heat-sensitive recording systems, visible information is often recorded on a base other than paper, e.g., a plastic base or information recording card such as a pre-paid card, a sealless pass, a coupon card, or the like. For this purpose, a recorded image must have good resistance to wear, resistance to weather, resistance to water, chemical resistance, and forgery preventive property. In addition, a demand has arisen for a recording system in which information recorded in, e.g., a computer can be easily output and recording can be performed with a mechanically simple arrangement.

Examples of the recording system which can satisfy the above requirements are direct heat-sensitive recording and thermal transfer recording. As the direct heat-sensitive recording, a heat-sensitive medium using a leuco dye is proposed (Japanese Patent Disclosure (Kokai) No. 59-199285) and practiced. However, since the leuco dye is used, reliability of an image after recording is poor, e.g., re-coloring occurs due to heating, discoloration or decoloration occurs due to light incidence, and storage stability over time is degraded. In order to solve these problems, a heat-sensitive recording medium using a metal deposited film is proposed (Japanese Patent Disclosure (Kokai) No. 59-199284). According to this medium, although the above drawbacks are improved, a printing energy is high, and printing requires a long time. In addition, since a recording layer is a metal deposited film, no contrast is obtained between non-image and image portions, and a background has a metallic color, i.e., has no whiteness. For this reason, applications are limited to special purposes. That is, according to the direct heat-sensitive recording type, recording itself has problems, applications are limited, and only mono-color visible information can be obtained because of its recording system. In the thermal transfer recording type, a thermal transfer material consisting of a hot-melt ink layer such as wax is superposed on a recording material obtained by forming a porous ink absorbing layer on a plastic base, thereby performing transferring and printing. In this system, by changing coloring agents of the ink layer of the thermal transfer material, full-color visible information can be printed. However, if an image portion is rubbed by a hand or the like, tailing and contamination occur, thereby degrading reliability of a recorded image. If stability of the recorded image is improved, this system is preferable because applications are not limited, i.e., it can be used in a variety of fields.

SUMMARY OF THE INVENTION

The present invention has been made in consideration of the above situation and has as its object to provide a thermal transfer material, a recording material, and a thermal transfer recording method using the same, thereby to allow a recording visible information (image) to be formed on a base such as a plastic by a thermal medium such as a thermal head and to obtain an image with good stability, resistance to a plasticizer, and mechanical strength.

According to an aspect of the present invention, there is provided a thermal transfer material comprising: a heat-resistant support; and a first thermal transfer recording layer stacked on the support and mainly consisting of a coloring agent, a hot-melt material comprising a thermoplastic resin having a glass transition point temperature falling within the range of 50° to 110° C., and a lubricating agent.

According to another aspect of the present invention, there is provided a material according to claim 1, further comprising a second thermal transfer recording layer provided between the support and the first thermal transfer recording layer and mainly consisting of a wax.

According to still another aspect of the present invention, there is provided a material according to claim 1, wherein the first thermal transfer recording layer mainly consists of a hot-melt material, a coloring agent, and a lubricating agent, the hot-melt material consisting of a linear saturated polyester resin prepared by condensation polymerization of a dicarboxylic acid component and a diol component and an acrylic resin having a glass transition point falling within the range of 50° to 110° C.

According to still another aspect of the present invention, there is provided a recording material comprising: a support; and an image-receiving layer provided on the support and mainly consisting of a lubricating agent and a thermoplastic resin having a glass transition point falling within the range of 50° to 110° C.

According to still another aspect of the present invention, there is provided a material according to claim 7, wherein the thermoplastic resin provided on the support is selected from the group consisting of a linear saturated polyester resin formed by condensation polymerization of a dicarboxylic component and a diol component, an acrylic resin, and a mixture of the saturated polyester resin and the acrylic resin.

According to still another aspect of the present invention, there is provided a thermal transfer recording method comprising the steps of: superposing a thermal transfer material comprising a heat-resistant support and a first thermal transfer recording layer stacked on the support and mainly consisting of a coloring agent, a hot-melt material comprising a thermoplastic resin having a glass transition temperature falling within the range of 50° to 110° C., and a lubricating agent, and a recording material comprising an image-receiving layer formed on another a support and mainly consisting of a lubricating agent and a thermoplastic resin having a glass transition point falling within the range of 50° to 110° C., so that the transfer recording layer and the image-receiving layer are brought into contact with each other; heating a portion of the thermal transfer material corresponding to printing image information from the side of the support; selectively thermally melting the recording layer and the image-receiving layer corresponding to the heated portion so that the layers are thermally adhered with each other; and forming a thermal transfer image on the recording material.

According to still another aspect of the present invention, there is provided a thermal transfer recording method comprising the steps of: superposing a thermal transfer material comprising a heat-resistant support, a first thermal transfer recording layer stacked on the support and mainly consisting of a coloring agent, a hot-melt material comprising a thermoplastic resin having a glass transition temperature falling within the range of 50° to 110° C., and a lubricating agent, and a second thermal transfer recording layer formed between the support and the first thermal transfer recording layer and mainly consisting of a wax, and a recording material comprising an image-receiving layer formed on another support and mainly consisting of a lubricating agent and a thermoplastic resin having a glass transition point falling within the range of 50° to 110° C., so that the transfer recording layer and the image-receiving layer are brought into contact with each other; heating a portion of the thermal transfer material corresponding to printing image information from the side of the support; selectively thermally melting the recording layer and the image-receiving layer corresponding to the heated portion so that the layers are thermally adhered with each other; and forming a thermal transfer image on the recording material.

According to still another aspect of the present invention, there is provided a thermal transfer recording method comprising the steps of: superposing a thermal transfer material comprising a thermal transfer recording layer stacked on a heat-resistant support and mainly consisting of a coloring agent, a hot-melt material consisting of a linear saturated polyester resin prepared by condensation polymerization of a dicarboxylic acid component and a diol component and an acrylic resin having a glass transition point falling within the range of 50° to 110° C., and a lubricating agent, and a recording material comprising an image-receiving layer formed on another support and mainly consisting of a lubricating agent and a thermoplastic resin having a glass transition point falling within the range of 50° to 110° C., so that the transfer recording layer and the image-receiving layer are brought into contact with each other; heating a portion of the thermal transfer material corresponding to printing image information from the side of the support; selectively thermally melting the recording layer and the image-receiving layer corresponding to the heated portion so that the layers are thermally adhered with each other; and forming a thermal transfer image on the recording material.

According to still another aspect of the present invention, there is provided a thermal transfer recording method comprising the steps of: superposing a thermal transfer material comprising a first thermal transfer recording layer stacked on a heat-resistant support and mainly consisting of a coloring agent, a hot-melt material comprising a thermoplastic resin having a glass transition point falling within the range of 50° to 110° C., and a lubricating agent, and a recording material comprising an image-receiving layer formed on another support and mainly consisting of a lubricating agent and a thermoplastic resin selected from the group consisting a linear saturated polyester resin prepared by condensation polymerization of a dicarboxylic acid component and a diol component, an acrylic resin, and a mixture of the saturated polyester resin and the acrylic resin, so that the transfer recording layer and the image-receiving layer are brought into contact with each other the thermoplastic resin having a glass transition point falling with in the range of 50° to 110° C.; heating a portion of the thermal transfer material corresponding to printing image information from the side of the support; selectively thermally melting the recording layer and the image-receiving layer corresponding to the heated portion so that the layers are thermally adhered with each other; and forming a thermal transfer image on the recording material.

DETAILED DESCRIPTION OF THE PREFERRED EMBODIMENT

A thermal transfer material according to the present invention will be described in detail below.

Figure 1:
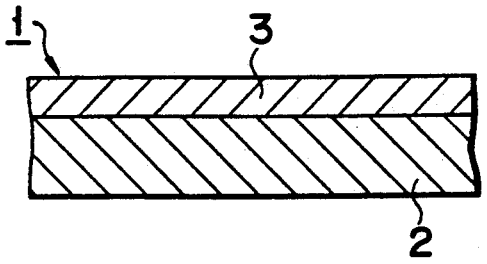
FIG. 1 is a sectional view of a thermal transfer material according to a first embodiment of the present invention.

According to a first embodiment of the present invention, thermal transfer material 1 is obtained by forming first transfer recording layer 3 mainly consisting of a thermoplastic resin coloring agent and a lubricating agent to be described below on support 2 such as a plastic support, as shown in FIG. 1.

Figure 3:
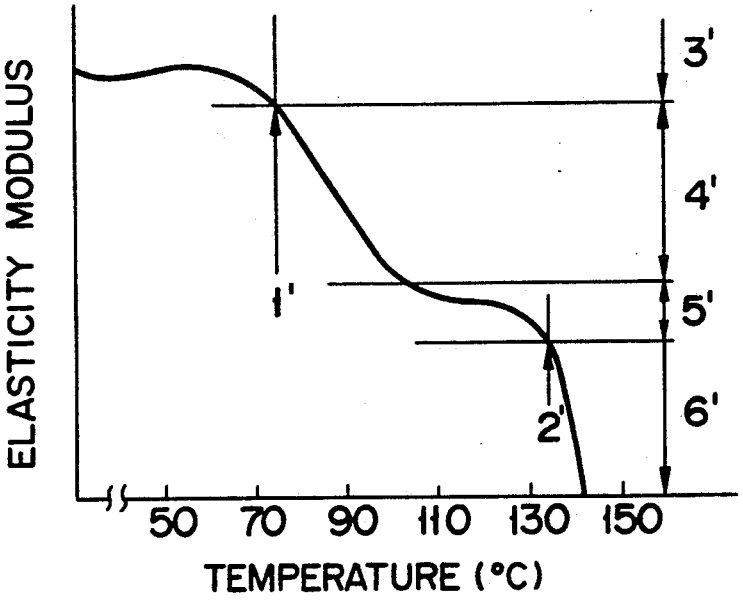
FIG. 3 is a graph showing a state change of a thermoplastic resin having a glass transition point of 75° C.
Figure 4:
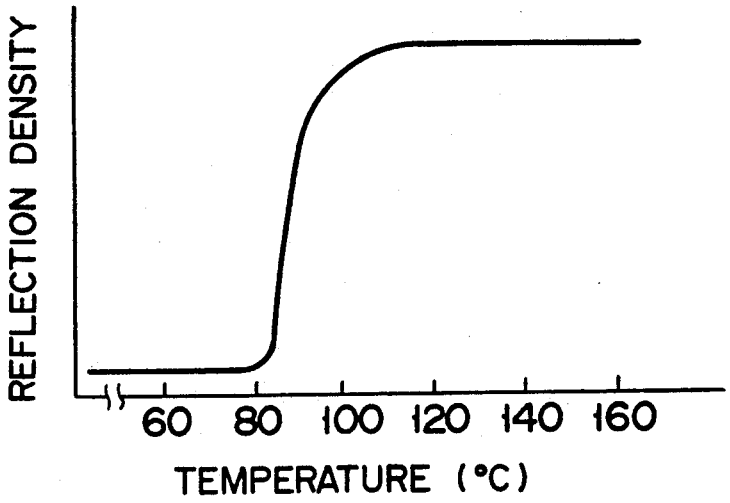
FIG. 4 is a graph showing a thermal transfer sensitivity curve of a thermal transfer material having the thermoplastic resin in FIG. 3 as a hot-melt material.

The thermoplastic resin used as a material of recording layer 3 has a glass transition point falling within the range of 50° to 110° C. and sensitivity capable of performing thermal transfer recording by a thermal medium such as a thermal head. A thermal transfer mechanism obtained when this thermoplastic resin is used as a hot-melt material will be described below with reference to the drawing. FIG. 3 is a graph showing a state change (E−T curve) obtained when a thermoplastic resin having a glass transition point of 75° C. is heated, and FIG. 4 is a graph showing a thermal transfer sensitivity curve (heating time: 5 sec, pressure: 1 kg/cm$^2$) of a thermal transfer material having this thermoplastic resin as a hot-melt material.

In FIG. 3, reference numeral 1' denotes a glass transition point; 2', a softening point (liquid fluidizing temperature); 3', a glass state; 4', a rubbery state; 5', a rubbery fluid state; and 6', a liquid fluid state. As shown in FIG. 4, the lowest temperature capable of performing thermal transfer recording is about 100° C. At this temperature, as shown in FIG. 3, the resin is in the rubbery fluid state between the rubbery state and the liquid fluid state. That is, the thermal transfer material is thermally transferred onto a recording material at a temperature of the rubbery fluid state or more and is not thermally transferred at temperatures lower than that.

As a result of extensive studies based on the above findings, in the thermal transfer material having the above arrangement, the above object can be achieved by setting the glass transition point of the thermoplastic resin which constitutes the transfer recording layer of the material within the range of 50° to 110° C. and by selecting a specific resin. That is, if the glass transition point is 110° C. or more, thermal transfer recording cannot be easily performed under normal printing conditions (in which a printing energy does not largely reduce a life of a thermal head). Therefore, the printing energy must be increased. However, if the printing energy is increased and thermal transfer recording is performed, a support serving as a base of the thermal transfer material is degraded, and the support is undesirably adhered or sticked to the thermal head.

The glass transition point of the thermoplastic resin used as the thermal transfer material of the present invention is set at 50° C. or more to obtain stability of the image thermally transferred on the recording material which is the object of the present invention. The stability of the thermally transferred image means that no tailing is produced when the image is rubbed by a hand under normal environmental conditions. That is, in a conventional thermal transfer material, wax or a thermoplastic resin having a low melting point is used as a hot-melt material. When such a material is rubbed after it is thermally transferred on a plastic, tailing is produced. In the present invention, in order to eliminate the drawback of tailing, the glass transition point of the thermoplastic resin is set at 50° C., and a polyester resin, a PVC resin, an acrylic resin, polyamide resin, polyacetal resin and a vinyl resin are selected from thermoplastic resins having glass transition points of 50° C. to 110° C., thereby giving a chemical resistance to the image thermally transferred and recorded on the recording material. It is also preferred in view of image stability, chemical stability and mechanical strength to select among these resins those having a molecular weight of from 5,000 to 20,000.

Examples of the thermoplastic resin are polyester resins such as a saturated polyester resin as prepared by a condensation polymerization of a dicarboxylic acid and diol; polyvinyl chloride resins such as a polyvinyl chloride resin, a polyvinyl chloride acetate resin, a modified polyvinyl chloride acetate copolyner; acrylic resins such as polymethylchloroacrylate, polymethylmethacrylate, polymethacrylonitrile, polyacrylonitrile; polyacrylic acid, 2-polymethoxyethyl-2-acrylate, polymethyl acrylate, poly-2-naphthyl acrylate, polyisobornyl acrylate, polyethyl methacrylate, poly-t-butyl methacrylate, polyisobutyl methacrylate, polyphenyl methacrylate (Tg: 110° C.), and a copolymer of methyl methacrylate and alkyl methacrylate (the number of carbon atoms of an alkyl group is 2 to 6); and vinyl resins such as polystyrene, polydivinylbenzene, polyvinyltoluene, styrene-alkylmethacrylate copolymer (the alkyl group having C1–C6) and a styrene-butadiene copolymer; polyamide resins such as nylon 6, 6; nylon 6, 7; nylon 6, 8; nylon 6, 9; nylon 6, 10; nylon 6, 12 and nylon 10; and polyacetal resins such as polyvinyl butyral and polyvinyl acetal. In order to obtain an adhesion property with respect to the recording material which is a plastic or the like, a thermoplastic resin having compatibility with the recording material is selected from the above examples and used as the hot-melt material. The compatibility between the polymers can be predicted by a solubility parameter. For example, an acryl film may be used as the recording material. When thermal transfer recording is performed on a sheet, the acrylic resin or the PVC resin may be used as the hot-melt material of the first thermal transfer recording material. When thermal transfer recording is performed on a polyester film or sheet, the polyester resin or the PVC resin may be selected as the hot-melt material. As a result, the adhesion property between the recording material and the thermally transferred image can be improved.

A preferred example of the hot-melt material of the first thermal transfer material is a combination of a linear saturated polyester obtained by condensation polymerization of a dicarboxylic acid component and a diol component and an acrylic resin having a glass transition point (to be referred to as Tg hereinafter) falling within the range of 50° to 110° C. The saturated polyester is added to improve the adhesion property of the transfer recording layer with the support consisting of a plastic or the like, e.g., a polyester film. If the saturated polyester is not added, a non-transferred recording portion may be removed and transferred to the recording material when thermal transfer recording is performed because the adhesion property between the support and the transfer recording layer is weak, thereby degrading sharpness of the image. That is, the saturated polyester is added to improve sharpness of the image upon transfer recording. The content of the saturated polyester is preferably 10 to 30 parts by weight with respect to 100 parts by weight of the hot-melt material. The acrylic resin which is another component of the hot-melt material is selected to improve reliability of the recorded image. The acrylic resin has the best resistance to a plasticizer among all the thermoplastic resins. When a medium such as a non-rigid PVC sheet or an eraser is brought into contact with the transferred/recorded image portion, a reduction in scratching of a recorded surface with respect to a practicizer contained in the medium or transition of the recorded image to the medium can be prevented by the acrylic resin which is adopted as a material of the transfer recording layer.

Examples of the acrylic resin having a glass transition point of 50° to 110° C. used in the present invention are polyacrylic acid (Tg: 72° C.), poly-2-methoxyethyl acrylate (Tg: 85° C.), polymethyl acrylate (Tg: 100° C.), poly-2-naphthyl acrylate (Tg: 72° C.), polyisobornyl acrylate (Tg: 94° C.), polymethyl methacrylate (Tg: 103° C.), polyethyl methacrylate (Tg: 65° C.), poly-t-butyl methacrylate (Tg: 107° C.), polyisobutyl methacrylate (Tg: 53° C.), polyphenyl methacrylate (Tg: 110° C.), a copolymer of methyl methacrylate and alkyl methacrylate (the number of carbon atoms of an alkyl group is 2 to 6), polymethylchloroacrylate (Tg: 83° C.), and polyisopropyl- -chloroacrylate (Tg: 71° C.).

A lubricating agent which is a component of the transfer recording layer of the thermal transfer material according to the present invention is required to improve a transfer property upon thermal transfer and the resistance to wear of the image which is thermally transferred and recorded. When thermal transfer recording is performed to the recording material by a thermal medium such as a thermal head, a non-thermal transferred portion is sometimes removed and transferred to the recording material, i.e., sharpness of the image is degraded.

When a lubricating agent is added to the transfer recording layer, sharpness is improved upon thermal transfer recording and a transferred image with high resolution is obtained. In addition, the resistance to wear of the recorded image is further improved. Since the resistance to wear is improved, damage to the image caused by scratching, such as a scratch can be prevented, and durability with respect to an eraser or the like is given to the recorded image. Examples of the lubricating agent used in the present invention are a Teflon powder, a polyethylene powder, animal, vegetable, mineral, and petroleum natural waxes, a synthetic hydrocarbon, a modified wax, an aliphatic alcohol and an acid, an aliphatic acid ester and glyceride, a hydrogenated wax, a synthetic ketone, an amine and an amide, a chlorinated hydrocarbon, a synthetic animal wax, a synthetic wax such as an alphaolefin wax, and a metal salt of a higher fatty acid such as zinc stearate.

Normal dyes and pigments by which a color visible image can be obtained can be used as a coloring agent which is a component of the transfer recording layer of the thermal transfer material according to the present invention and are necessary to obtain a visible image. Inorganic and organic pigments are preferable in consideration of the resistance to weather of the transferred/recorded image. Examples are titanium oxide, calcium carbonate, Hansa yellow, oil yellow-2G, carbon black, oil black, pyrazolone orange, oil red, blood red, anthraquinone violet, phthalocyanine blue, phthalocyanine green, an aluminum powder, a bronze powder, and pearl essence.

A composition ratio of the transfer recording layer of the present invention is such that 40 to 80 parts by weight of the thermoplastic resin, 10 to 30 parts by weight of the coloring agent, and 5 to 30 parts by weight of the lubricating agent, respectively, are added with respect to 100 parts by weight of a total solid content of the transfer recording layer.

The transfer recording layer of the present invention may contain various additives in addition to the above components without degrading the characteristics of the present invention.

However, the content of the additives must be 0 to 10 parts by weight with respect to 100 parts by weight of the above components.

A support used in the thermal transfer material of the present invention need only have heat-resistance and high size stability and surface smoothness. Preferably, the support is obtained by forming a layer for preventing sticking to the thermal head on a rear surface of a 2 to 10 μm thick polyester film.

The thermal transfer material of the present invention is manufactured as follows. That is, a thermal transfer recording composition mainly consisting of a thermoplastic resin, a coloring agent, and a lubricating agent is uniformly dispersed/dissolved in a suitable solvent to manufacture a coating liquid. This coating liquid is coated and dried on a support such as a polyester film by bar coating, blade coating, air knife coating, gravure coating, or roll coating to form a thermal transfer recording layer, thereby manufacturing the thermal transfer material.

Figure 2:
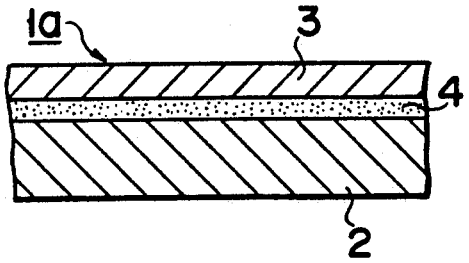
FIG. 2 is a sectional view of a thermal transfer material according to a second embodiment of the present invention.

FIG. 2 shows a thermal transfer material according to a second embodiment of the present invention consisting of at least second thermal transfer recording layer 4 formed on support 2 such as a plastic and mainly consisting of wax, and first thermal transfer recording layer 3 formed on recording layer 4 and consisting of a coloring agent, a hot-melt material (a thermoplastic resin), and a lubricating agent.

Recording using the thermal transfer material of the present invention is performed as follows. That is, first, the thermoplastic resin of recording layer 3 serving as a thermal transfer recording layer is heated up to a temperature of a rubbery fluid state or more by a thermal medium such as a thermal head. At this time, recording layer 3 which is imparted viscosity upon heating is thermally adhered to the recording material such as a plastic and transferred/recorded thereon. If a temperature is lower than the above one, no transfer recording is performed. In this case, if recording layer 3 is directly brought into contact with the support (i.e., recording layer 4 is not formed), an adhesion property of the recording layer with respect to the support is increased by viscosity imparted upon heating because the thermoplastic resin is heated up to the temperature of the rubbery fluid state or more. Therefore, removal of the recording layer may be prevented upon transfer recording.

In order to eliminate this phenomenon, in the present invention, the second thermal transfer recording layer mainly consists of a wax having low hot-melt viscosity and a weak adhesion property with respect to the support. Therefore, a removal property from the support upon thermal transfer recording is improved.

As described above, the second thermal transfer recording layer of the present invention is provided to obtain a good removal property of the first thermal transfer recording layer with respect to the support. The second thermal transfer recording layer mainly consists of a wax in an amount of preferably 70 wt % or more with respect to the total solid content of the first thermal transfer recording layer. Examples of such a substance is a material having a melting point of 60° to 120° C. such as a paraffin wax, a carnauba wax, a montan wax, and a higher fatty acid, a higher alcohol, a higher fatty acid ester, and a higher fatty acid amide.

The thermal transfer material of the second embodiment is manufactured as follows. That is, first, the second thermal transfer recording layer is coated and dried on the support such as a polyester film by a hot-melt or solvent coating method. Then, the first thermal transfer recording coating liquid obtained by uniformly dispersing or dissolving a thermal transfer recording composition mainly consisting of the coloring agent, the thermoplastic resin, and the lubricating agent in a suitable solvent is coated and dried on the second thermal transfer recording layer by solvent coating such as bar coating, blade coating, air knife coating, gravure coating, or roll coating to form the first thermal transfer recording layer, thereby manufacturing the thermal transfer material.

The recording layer of the present invention will be described below.

The recording material which is used in combination with the thermal transfer material of the present invention is obtained by forming an image-receiving layer mainly consisting of a lubricating agent and a thermoplastic resin on a support such as a metal or plastic sheet, and preferably, a plastic sheet. In this case, any thermoplastic resin such as those useful for the thermal transfer recording layer as mentioned above can be used as long as it has a Tg falling within the range of 50° to 110° C. and an adhesion property with respect to the transfer recording layer of the thermal transfer material of the present invention.

If a thermoplastic resin having a glass transition point of 110° C. or more is used in the image-receiving layer, although transfer recording is performed, mechanical strength of a transferred image is weak because it is not thermally sufficiently adhered. Therefore, when the image is rubbed by a plastic eraser, it may be erased. The glass transition point is set at 50° C. or more to obtain durability of the image-receiving layer. If the image-receiving layer has a temperature lower than that, it may lack reliability in terms of a resistance to wear, a resistance to a plasticizer, and a chemical resistance. In consideration of the chemical resistance and the resistance to a plasticizer, the acrylic resin used in the transfer recording layer of the thermal transfer material as described above is preferred. Some plastic sheets used as the support of the thermal transfer material have no adhesion property with respect to the acrylic resin. In this case, a resin having a good adhesion property must be used to obtain an adhesion property. For example, when a polyester sheet is used as the support, a saturated polyester resin is added to obtain the adhesion property.

In addition, a linear saturated polyester resin formed by condensation polymerization of a dicarboxylic acid component and a diol component may be singly used as the thermoplastic resin for the image-receiving layer.

The lubricating agent to be incorporated into the image-receiving layer may be any of those as hereinbefore described with respect to the thermal transfer material. The content of the lubricating agent may range from 5 to 30 parts by weight per 100 parts by weight of the total solid content of the image receiving layer.

Figure 5:
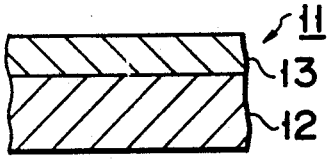
FIG. 5 is a sectional view of an arrangement of a recording material according to the present invention.
Figure 8:
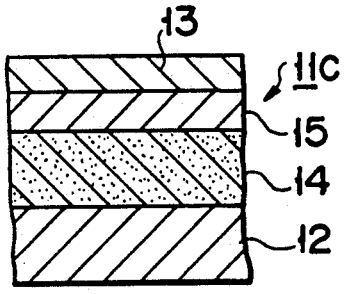
FIGS. 6 to 8 are sectional views of the recording materials having magnetic recording layers, respectively.
Figure 6:
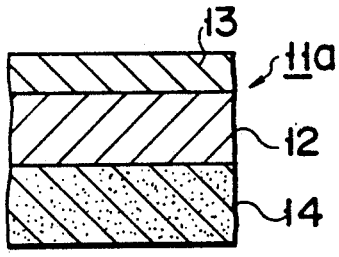
Figure 7:
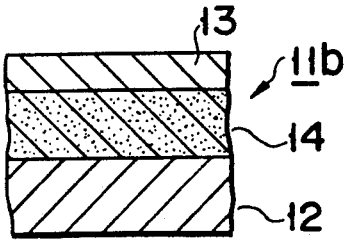

An arrangement of the recording material is as follows. That is, as shown in FIG. 5, recording material 11 is constituted by base 12 and imaging layer 13 formed thereon. FIGS. 6 to 8 show arrangements for a base having a magnetic recording layer. That is, recording layer 11*a* shown in FIG. 6 is obtained by forming image-receiving layer 13 on base 12 and forming magnetic recording layer 14 at the side of base 12 opposite to image-recording layer 13. Recording layer 11*b* shown in FIG. 7 is obtained by forming magnetic recording layer 14 on base 12 and forming image-receiving layer 13 thereon. In FIG. 8, magnetic recording layer 14, coloring layer 15, and image-receiving layer 13 are sequentially formed on base 12. In this case, coloring layer 15 must have a hue different from that of an image to be thermally transferred and recorded on image-receiving layer 13.

A thermal transfer recording method using the thermal transfer material and recording material having the above arrangements will be described below.

Figure 9:
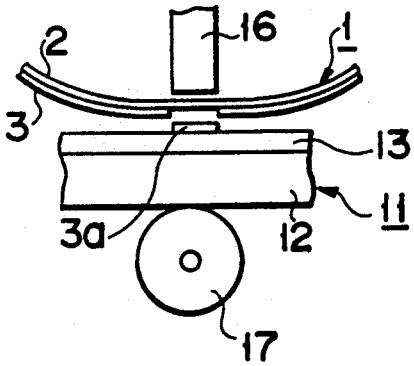
FIG. 9 is a schematic view for explaining a thermal transfer recording method of the present invention.

When recording is to be performed, thermal transfer material 1 and recording material 11 are superposed between thermal medium 16 and urge roller 17 so that transfer recording layer 3 and image-receiving layer 13 face each other, as shown in FIG. 9. Then, a portion of thermal transfer material 1 corresponding to printing image information is heated from the side of support 2 by thermal medium 16 such as a thermal head or a thermal pen. As a result, a portion of recording layer 3 corresponding to the heated portion is thermally melted. At the same time, a thermoplastic resin in image-receiving layer 13 is heated up to a temperature of Tg or more by a thermal energy transmitted to recording material 11 through thermal transfer 1. Therefore, hot-melt recording layer 3 and image-receiving layer 13 are partially thermally adhered with each other with a good adhesion property, thereby forming thermal transfer image 3*a* on recording material 11. Transferred/-recorded image 3*a* has good resistance to a plasticizer, chemical resistance, and mechanical strength.

As has been described above, according to the present invention, printing can be performed on a base such as a plastic by a thermal medium such as a thermal head. In addition, basic characteristics such as color display and monochrome display can be obtained, and durability, especially, the resistance to a plasticizer and the mechanical strength of the image which is thermally transferred and recorded on the thermal transfer material can be obtained. Therefore, the present invention can be applied to various fields to which the conventional thermal transfer materials cannot be applied, e.g., recording on a plastic or the like, a card or the like which must prevent forgery, recording of variable information on a sealless pass or the like, and a balance display medium such as a pre-payed card.

The present invention will be described by way of its Examples below. Note that in the examples, the term "parts" represent parts by weight.

<EXAMPLE 1>

| Composition of Transfer Recording Layer Coating Liquid | |
|---|---|
| Carbon Black | 1 part |
| Methyl methaacrylate (Tg = 105° C.) (BR-80 (tradename) available from Mitsubishi Rayon Co., Ltd.) | 6 parts |
| Paraffin Wax | 1 part |
| Toluene/2-Butanone (1/1) | 30 parts |

A coating liquid consisting of the above composition was ground and dispersed by a sand mill for two hours to obtain a transfer recording layer coating liquid. The resultant material was coated and dried on a 6-$\mu$ thick polyester film obtained by forming a sticking preventing layer on its rear surface by a wire bar so as to have a dry weight of 3 g/m$^2$, thereby preparing a thermal transfer material.

<EXAMPLE 2>

| Composition of Transfer Recording Layer Coating Liquid | |
|---|---|
| Phthalocyanine Blue | 2 parts |
| Methacrylic Acid Ester (Tg = 55° C.) (BR-64 (tradename) available from Mitshubishi Rayon Co., Ltd.) | 10 parts |
| Polyvinyl Chloride-Acetate Copolymer (Tg = 68° C.) (VAGH (tradename) available from UCC) | 3 parts |
| Teflon Powder | 1 parts |
| 2-Butanone | 50 parts |

A coating liquid consisting of the above composition was ground and dispersed by a paint conditioner for 30 minutes to obtain a transfer recording layer coating liquid. The resultant material was coated and dried on a 6-$\mu$ thick polyester film obtained by forming a sticking preventing layer on its rear surface by a wire bar so as to have a dry weight of 4 g/m$^2$, thereby preparing a thermal transfer material.

<EXAMPLE 3>

| Composition of Transfer Recording Layer Coating Liquid | |
|---|---|
| Oil Red | 1.5 parts |
| Polyester (Tg = 65° C.) (UE-3200 (tradename) available from UNITIKA, LTD.) | 5 parts |
| Polystyrene (Tg = 110° C.) (DENKA STYROL (tradename) available from Denka K.K.) | 2 parts |
| Polyethylene Powder | 1 part |
| Toluene/2-Butanone (1/2) | 40 parts |

A coating liquid consisting of the above composition was ground and dispersed by a sand mill for an hour to obtain a transfer recording coating liquid. The resultant material was coated and dried on a 6-μ thick polyester film obtained by forming a sticking preventing layer on its rear surface by a wire bar so as to have a dry weight of 3 g/m$^2$, thereby preparing a thermal transfer material.

<COMPARATIVE EXAMPLE 1>

A thermal transfer material was prepared following the same procedures as in Example 3 except that polyester (Tg=65° C.) and polystyrene (Tg=110° C.) used as a hot-melt material (thermoplastic resin) in Example 3 were replaced with low-melting polyester (Tg=5° C.) and styrene oligomer (Tg=30° C.).

<COMPARATIVE EXAMPLE 2>

A thermal transfer material was prepared following the same procedures as in Example 3 except that the polyethylene powder which is a composition of the transfer recording layer of Example 3 was omitted.

<EVALUATIONS OF EXAMPLES 1 TO 3 AND COMPARATIVE EXAMPLES 1 AND 2>

The resultant thermal transfer materials were used for thermal transfer on a plastic sheet (recording material) by a thermal simulator available from TOSHIBA CORP. (printing conditions: application power=0.45 W/dot, pulse width=2.5 ms ON/OFF).

TABLE 1

| Terminal transfer Material | Recording Material | Transfer Property | Characteristics of Image affer Recording: Resistance to Scratch | Resistance to Wear | Resistance to Plasticizer | Resistance to Solvent |
|---|---|---|---|---|---|---|
| Example 1 | Acrylic Sheet | | | | | |
| Example 2 | PCV Sheet | | | | | |
| Example 3 | Polyeter sheet | | | | | |
| Comparative Example 1 | Polyester Sheet | | X | X | X | |
| Comparative Example 2 | Polyester Sheet | X | X | X | | |

* 1 A degree of transfer of a non-transferred portion to a recording material upon thermal transfer recording
  o: the portion was not transferred
  x: the portion was transferred
* 2 A degree of tailing of an image portion obtained when the portion was rubbed by a nail with a normal force
  o: tailing was not observed
  x: tailing was observed
* 3 A degree of color erasure of an image portion obtained when the portion was rubbed 20 times by a plastic erasure with a normal force
  o: the portion remained
  x: the portion was erased
* 4 A state of an image portion obtained when the portion was urged against a plastic erasure (200 g/cm$^2$) at 20° C. and an RH of 60% for two days
  o: no change
  x: scratch is reduced
* 5 A state of an image portion obtained after the portion was dipped in water or ethanol for three minutes
  o: no change
  x: decoloration and degradation in strength were observed As is apparent from Table 1, according to the present invention, printing can be performed on a plastic. In addition, a thermally transferred/recorded image having durability (e.g., resistance to wear, resistance to scratch, resistance to a plasticizer, and resistance to a solvent) which cannot be obtained in the Comparative Examples can be obtained.

<EXAMPLE 4>

A carnauba wax was coated on a 6-μ thick polyester film obtained by forming a sticking preventing layer on its rear surface by hot-melt coating (flexographic printing) to have a dry weight of 1.5 g/m$^2$, thereby preparing a second thermal transfer recording layer. A coating liquid consisting of the following composition was ground and dispersed by a sand mill for an hour to obtain a first thermal transfer recording layer coating liquid. The resultant material was coated and dried on the second thermal transfer recording layer by bar coating to have a dry weight of 2.0 g/m$^2$ to form a first thermal transfer recording layer, thereby preparing a thermal transfer sheet.

| | |
|---|---|
| Carbon Black | 1 part |
| Saturated Polyester (Tg = 65° C.) (UE-3200 (tradename available from UNITIKA, LTD.) | 5 parts |
| Paraffin Wax | 0.5 parts |
| Toluene/2-Butanone (1/1) | 30 parts |

<EXAMPLE 5>

| Coating Liquid | |
|---|---|
| Composition of Second Thermal Transfer Recording Layer | |
| Rice Wax | 2 parts |
| Polyester Wax | 1 part |
| Toluene | 15 parts |
| Composition of First Thermal Transfer Recording Layer | |

-continued

| Coating Liquid | |
|---|---|
| Carbon Black | 1.5 parts |
| Methyl methacrylate (Tg = 105° C.) (BR-80 (tradename) available from Mitsubishi Rayon Co., Ltd.) | 5 parts |
| Polyvinyl Chloride-Acetate Copolymer (Tg = 65° C.) (ELEX A (tradename) available from Sekisui Chemical Co., Ltd.) | 2 parts |
| Teflon Powder | 1 part |
| Toluene/2-Butanone (2/1) | 40 parts |

A second thermal transfer recording layer coating liquid consisting of the above composition was ground and dispersed by a pain conditioner for an hour. The resultant material was coated and dried on a surface of a 4-μ thick polyester film whose rear surface was subjected to heat-resistant processing by a wire bar to have a dry weight of 1.0 g/m², thereby forming a second thermal transfer recording layer. Then a first thermal transfer recording layer coating liquid which was ground and dispersed by a sand mill was coated and dried on the second thermal transfer recording layer to have a dry weight of 3.0 g/m² by a wire bar to form a first thermal transfer recording layer, thereby preparing a thermal transfer sheet.

<COMPARATIVE EXAMPLE 3>

A thermal transfer sheet was prepared following the same procedures as in Example 1 except that the saturated polyester resin (Tg=65° C.) which was the hot-melt material of the first thermal transfer recording layer in Example 4 was replaced with low-melting polyester (Tg=5° C.).

<EVALUATIONS OF EXAMPLES 4 AND 5 AND COMPARATIVE EXAMPLE 3>

The prepared thermal transfer sheets were used for thermal transfer on a 250-μ thick PVC sheet (recording material) by a thermal simulator (printing conditions: application power=0.4 W/dot, pulse width=2.5 ms ON/OFF). As a result, a clear image was obtained in each of the Examples and the Comparative Example. Durability of the transferred/recorded images was evaluated. The results are summarized in Table 2 below.

As is apparent from Table 2, according to the thermal transfer material of the present invention, an excellent thermally transferred/recorded image having durability (e.g., resistance to a plasticizer, resistance to wear, resistance to scratch, and chemical resistance) which cannot be obtained by the Comparative Example can be obtained.

TABLE 2

| | | Characteristics of Image affer Recording | |
|---|---|---|---|
| | Transfer Property | Resistance to Plasticizer | Chemical Resistance |
| Example 4 | | | |
| Example 5 | | | |
| Comparative Example 3 | | X | |
| Example 4 | | | |
| Example 5 | | | |
| Comparative Example 3 | | X | X |

* 1 A transfer recording property obtained under the printing conditions of 0.40 W/dot and 2.5 ms ON/-OFF
  o: recorded image was clear
  x: recorded image was not clear
* 2 A state of a recording surface obtained after the surface was urged against a plastic eraser (200 g/m²) at 20° C. and an RH of 60% for two months
  o: no change
  x: image transfer and strength degradation were present
* 3 A state of a recording surface obtained after the surface was dipped in water and ethanol for three minutes
  o: no change
  x: eluation and strength degradation were present
* 4 A degree of color erasure of an image portion obtained when the portion was rubbed by a plastic eraser 50 times with a normal force
  o: the portion remained
  x: the portion was erased
* 5 A degree of tailing of an image portion obtained when the portion was rubbed by a nail with a normal force
  o: tailing was not observed
  x: tailing was observed

<EXAMPLE 6>

| (1) Preparation of Thermal Transfer Material Composition of Thermal Transfer Recording Layer Coating Liquid | |
|---|---|
| Carbon Black | 1 part |
| Saturated Polyester (BYRON 103 (tradename) available from TOYOBO CO., LTD.) | 2 parts |
| Acrylic Resin (Tg = 105° C.) (BR-80 (tradename) available from Mitsubishi Rayon Co., Ltd.) | 4 parts |
| Paraffin Wax | 0.5 parts |
| Toluene/2-Butanone (2/1) | 30 parts |

A coating liquid consisting of the above composition was ground and dispersed by a sand mill for two hours to obtain a transfer recording layer coating liquid. The resultant material was coated and dried on a 6-μ thick polyester film obtained by forming a sticking preventing layer on its rear surface by a wire bar so as to have a dry thickness of 1.5 g/m², thereby preparing a thermal transfer material.

| (2) Preparation of Recording Material Composition of Image-Receiving Coating Liquid | |
|---|---|
| Polyethylene Wax | 1 part |
| Acrylic Resin (Tg = 750° C.) (BR-60 (tradename) available from Mitsubishi Rayon Co., Ltd.) | 10 parts |
| Toluene/2-Butanone (1/1) | 50 parts |

A coating liquid consisting of the above composition was dispersed by a sand grinder for 30 minutes to obtain an image-receiving layer coating liquid. The resultant material was coated and dried on a 250-μ thick white PVC sheet by a wire bar so as to have a dry weight of 1 g/m², thereby preparing a recording material.

<EXAMPLE 7>

| (1) Preparation of Thermal Transfer Material Composition of Transfer Recording Layer Coating Liquid | |
|---|---|
| Aluminum Powder | 1.5 parts |
| Saturated Polyester (ETHER VE3210 (tradename) available from UNITIKA, LTD.) | 2 parts |
| Acrylic Resin (Tg = 60° C.) (BR-90 (tradename) available from Mitsubishi Rayon Co., Ltd.) | 5 parts |
| Polyethylene Powder | 1.5 parts |
| Toluene/2-Butanone (1/2) | 40 parts |

A coating liquid consisting of the above composition was ground and dispersed by a paint conditioner for 30 minutes to obtain a transfer recording layer coating liquid. The resultant material was coated and dried on a 4-μ thick polyester film obtained by forming a sticking preventing layer on its rear surface by a wire bar so as to have a dry weight of 2 g/m$^2$, thereby preparing a thermal transfer material.

| (2) Preparation of Recording Material Composition of Image-Receiving Layer Coating Liquid | |
|---|---|
| Teflon Powder | 2 parts |
| Saturated Polyester (BYRON 200 (tradename) available from TOYOBO CO., LTD.) | 4 parts |
| Acrylic Resin (Tg = 100° C.) (PARALOYD A-111 (tradename) available from Rome & House) | 6 parts |
| Toluene/2-Butanone | 50 parts |

A coating liquid consisting of the above composition was dispersed by a hyper for 30 minutes to obtain an image-receiving coating liquid. The resultant material was coated and dried on a 188-μ thick white polyester sheet by a wire bar so as to have a dry weight of 2 g/m$^2$, thereby preparing a recording material.

<COMPARATIVE EXAMPLE 4>

A thermal transfer material was prepared following the same procedures as in Example 7 except that the acrylic resin (Tg=60° C.) which is a hot-melt material used in Example 7 was replaced with acrylic resin (Tg=35° C.) (BR-65 (tradename) available from Mitsubishi Rayon Co., Ltd.). Note that a recording material used in this Comparative Example was the same as that used in Example 2.

<COMPARATIVE EXAMPLE 5>

A thermal transfer material and a recording material were prepared following the same procedures as in Example 7 except that the image-receiving layer of the recording material in Example 7 was not formed.

<EVALUATIONS OF EXAMPLES 6 AND 7 AND COMPARATIVE EXAMPLES 4 AND 5>

The prepared thermal transfer materials were used for thermal transfer recording on the corresponding recording materials by a thermal simulator (printing conditions: application power=0.45 W/dot, pulse width =2.5 ms ON/OFF), and characteristics obtained after recording were evaluated. The results are summarized in Table 3 below.

As is apparent from Table 3, according to the present invention, thermal transfer/recording can be performed by a thermal medium such as a thermal head. In addition, an excellent thermally transferred/recorded image having durability (e.g., a resistance to a plasticizer, a resistance to wear, a resistance to scratch, and a resistance to a solvent) which cannot be obtained by the Comparative Examples can be obtained.

TABLE 3

| | Transfer Property | Characteristics of Image after Recording: Resistance to Plasticizer | Resistance to Solvent | Resistance to Wear | Characteristics of Image after Recording Resistance to Plastic |
|---|---|---|---|---|---|
| Example 6 | | | | | |
| Example 7 | | | | | |
| Comparative Example 4 | | X | | X | X |
| Comparative Example 5 | X | | | X | |

* 1 Transfer recording characteristics obtained under the printing conditions of 0.45 W/dot and 2.5 ms ON/OFF
  o: recorded image was clear
  x: recorded image was not clear
* 2 A state of a recording surface obtained when the surface was urged against a plastic eraser (200 g/cm$^2$) at 20° C. and an RH of 60% for two days
  o: no change
  x: image transfer and strength degradation were present
* 3 A state of a recording surface obtained after the surface was dipped in water and ethanol
  o: no change
  x: eluation and strength degradation were present
* 4 A degree of color erasure of an image portion obtained when the portion was erased by a plastic eraser with a normal force
  o: the portion remained
  x: the portion was erased
* 5 A degree of tailing of an image portion obtained when the portion was rubbed by a nail with a normal force
  o: tailing was not observed
  x: tailing was observed

<EXAMPLE 8>

| Composition of Thermal Transfer Image-Receiving Layer Coating Liquid | |
|---|---|
| Teflon Powder | 2 parts |
| Saturated Polyester (Tg: 67° C.) (BYRON 200 (tradename) available from TOYOBO CO., LTD.) | 10 parts |
| Toluene/2-Butanone | 50 parts |

A coating liquid consisting of the above composition was dispersed by a hyper for 30 minutes to obtain an image-receiving layer coating liquid. The resultant material was coated and dried on a 188-μ thick white polyester sheet by a wire bar so as to have a dry weight of 2 g/m². The resultant material was cut into a desired sized to prepare a card.

<EXAMPLE 9>

| Composition of Magnetic Recording Layer Coating Liquid | |
|---|---|
| —$Fe_2O_3$ | 40 parts |
| Polyvinyl Chloride Acetate Resin (ESLEX A (tradename) available from Sekisui Chemical Col., Ltd.) | 7 parts |
| Polyurethane Elastomer (available from Nippon Polyurethane K.K.) | 3 parts |
| Toluene/2-Butanone (2/1) | 100 parts |
| Isocyanato Hardening Agent (CORONATE HL (tradename) available from Nippon Polyurethane K.K.) | 1 part |

| Composition of Thermal Transfer Image-Receiving Layer Coating Liquid | |
|---|---|
| Carnauba Wax | 1 part |
| Acrylic Resin (Tg: 105° C.) (BR-80 (tradename) available from Mitsubishi Rayon Co., Ltd.) | 10 parts |
| Toluene/2-Butanone | 50 parts |

A magnetic recording layer coating liquid not containing the above composition was uniformly dispersed by a sand mill for two hours to obtain a coating liquid. A coating liquid obtained by adding the isocyanato hardening agent of the above composition in the above coating liquid was coated and dried on a 250-μ thick rigid PVC sheet by a wire bar so as to have a dry thickness of 15 μ, thereby preparing a magnetic recording layer. The thermal transfer image-receiving layer coating liquid consisting of the above composition was dispersed by a hyper for 30 minutes to obtain an image-receiving layer coating liquid. The resultant material was coated and dried on one surface of a rigid PVC sheet having the magnetic recording layer by a wire bar so as to obtain a dry weight of 3 g/m² and then cut into a desired size, thereby preparing a card.

<EXAMPLE 10>

| Composition of Thermal Transfer Image-Receiving Layer Coating Liquid | |
|---|---|
| Polyethylene Powder | 2 parts |
| Saturated Polyester (Tg: 65° C.) (ESTER JE-3200 (tradename) available from UNITIKA, LTD.) | 5 parts |
| Acrylic Resin (Tg: 100° C.) (PARALOYD A-11 (tradename) available from Rome & House) | 5 parts |
| Toluene/2-Butanone (2/1) | 50 parts |

| Composition of Coloring Agent Layer Coating Liquid | |
|---|---|
| $TiO_2$ | 20 parts |
| Pyrooxyline Lacquer (25 wt %) (CEL LINE FM-200 (tradename) available from DAICEL K.K.) | 24 parts |
| Saturated Polyester (BYRON 103 (tradename) available from TOYOBO CO., LTD.) | 4 parts |
| Toluene/2-Butanone (1/1) | 40 parts |

-continued

| Composition of Coloring Agent Layer Coating Liquid | |
|---|---|
| Isocyanato Hardening Agent (CORONATE HL (tradename) available from Nippon Polyurethane K.K.) | 1 part |

Following the same procedures as in Example 9, a magnetic recording layer was formed on a rigid PVC sheet. The coloring agent layer coating liquid having the above composition which was uniformly dispersed by a sand mill was coated and dried on the above layer by a wire bar so as to have a dry weight of 3 g/m², thereby forming a coloring agent layer. Then, the above thermal transfer image-receiving layer coating liquid which was uniformly dispersed by a hyper was coated and dried on the coloring agent layer by a wire bar so as to have a dry weight of 1.5 g/m². The resultant material was cut into a predetermined size to prepare a card.

<EXAMPLE 11>

| Composition of Heat-Sensitive Adhesive Ink Layer | |
|---|---|
| Carbon Black | 2 parts |
| Methacrylic Acid Ester (BR-64 (tradename) available from Mitsubishi Rayon Co., Ltd.) | 10 parts |
| Polyvinyl Chloride-Acetate Copolymer (VAGH (tradename) available from VCC) | 3 parts |
| Teflon Powder | 1 part |
| 2-Butanone | 50 parts |

A coating liquid consisting of the above composition was ground and dispersed by a paint conditioner for 30 minutes to obtain a heat-sensitive adhesive ink layer coating liquid. The resultant material was coated and dried on a 6-μ thick polyester film obtained by forming a sticking preventing layer on its rear surface by a wire bar so as to have a dry weight of 3 g/m², thereby preparing a resin type transfer ribbon.

<EXAMPLE 12>

A resin type transfer ribbon was prepared following the same procedures as in Example 4 except that $TiO_2$ used as the coloring agent in Example 11 was replaced with an oil red.

<RECORDING OF EXAMPLES>

Card mediums prepared in accordance with Examples 8 to 10 and the resin type transfer ribbon in Example 11 or 12 were used to thermally transfer/record printing patterns such as OCR characters, Kanji characters, and Roman characters by a thermal simulator (printing conditions: application power=0.45 W/dot, pulse width =2.5 ms ON/OFF) available from TOSHIBA CORP. As a result, clear recorded images could be obtained. In addition, when durability of the recorded images were evaluated, an excellent thermally transferred/recorded image having good resistance to a plasticizer, chemical resistance, resistance to wear, and resistance to scractch could be obtained.

What is claimed is:

1. A thermal transfer material comprising:

a heat-resistant support; and a first thermal transfer recording layer stacked on said support and mainly consisting of a coloring agent, a hot-melt material comprising a linear saturated polyester resin prepared by condensation polymerization of a dicarboxylic acid component and diol component and having a glass transition point falling within the range of 50° to 110° C., and a lubricating agent selected from the group consisting of Teflon and polyethylene, said hot-melt material being capable of being thermally transferred and adhesively secured to an image receiving layer to form an adhesively secured image.

2. A material according to claim 1, wherein the contents of the coloring agent, the hot-melt material, and the lubricating agent are 10 to 30, 40 to 80, and 5 to 30 parts by weight, respectively, with respect to 100 parts by weight of a total solid content of said first thermal transfer recording layer.

3. A material according to claim 1, further comprising a second thermal transfer recording layer provided between said support and said first thermal transfer recording layer and mainly consisting of a wax.

4. A material according to claim 3, wherein the content of the wax is 70 to 100 parts by weight with respect to 100 parts by weight of a total solid content of said second thermal transfer recording layer.

5. A material according to claim 1, wherein said hot-melt material further comprises a thermoplastic resin selected from the group consisting of a polyamide resin, polyacetal resin and a vinyl resin, and having a glass transition point falling within the range of 50° to 110° C.

6. A material according to claim 1, wherein said hot-melt material further comprises an acrylic resin having a glass transition point falling within the range of 50° to 110° C.

* * * * *